US009150014B2

(12) United States Patent
Veenstra et al.

(10) Patent No.: US 9,150,014 B2
(45) Date of Patent: Oct. 6, 2015

(54) PRINTING METHOD

(71) Applicant: OCE-TECHNOLOGIES B.V., Venlo (NL)

(72) Inventors: Hylke Veenstra, Reuver (NL); Matheus Wijnstekers, Velden (NL); Johan Alexander Duijve, Venlo (NL)

(73) Assignees: OCE-TECHNOLOGIES B.V., Venlo (NL); MUTRACX, Helmond (NL)

( * ) Notice: Subject to any disclaimer, the term of this patent is extended or adjusted under 35 U.S.C. 154(b) by 0 days.

(21) Appl. No.: 14/032,737

(22) Filed: Sep. 20, 2013

(65) Prior Publication Data

US 2014/0015884 A1 Jan. 16, 2014

Related U.S. Application Data

(63) Continuation of application No. PCT/EP2012/054772, filed on Mar. 19, 2012.

(30) Foreign Application Priority Data

Apr. 6, 2011 (EP) ..... 11161254

(51) Int. Cl.
*B41J 29/393* (2006.01)
*B41J 2/07* (2006.01)
*B41J 2/21* (2006.01)

(52) U.S. Cl.
CPC *B41J 2/07* (2013.01); *B41J 2/2132* (2013.01); *B41J 2/2135* (2013.01)

(58) Field of Classification Search
CPC ..... B41J 2/04; B41J 2/0458; B41J 2/04535; B41J 2/2054; B41J 2/36
See application file for complete search history.

(56) References Cited

U.S. PATENT DOCUMENTS

| | | | | |
|---|---|---|---|---|
| 6,257,685 | B1 | 7/2001 | Ishikawa | |
| 6,312,099 | B1 * | 11/2001 | Hawkins et al. | 347/42 |
| 6,874,864 | B1 * | 4/2005 | Maeda et al. | 347/41 |
| 2005/0219296 | A1 | 10/2005 | Hirakawa | |
| 2009/0195578 | A1 | 8/2009 | Jung et al. | |
| 2009/0278882 | A1 | 11/2009 | Yoshida et al. | |

FOREIGN PATENT DOCUMENTS

JP 2007-245472 A 9/2007

* cited by examiner

*Primary Examiner* — Lamson Nguyen
(74) *Attorney, Agent, or Firm* — Birch, Stewart, Kolasch & Birch, LLP

(57) ABSTRACT

A printer and a method of printing by depositing liquid droplets (26) onto a substrate (12), wherein a line is printed in a printing direction (B), wherein the droplets (26) forming the line are continuously printed wet-on-wet, and wherein, at least in a middle part of said line, the droplets (26) are printed according to a regular droplet pattern, and wherein, at least in one end part of the line, at least an outermost droplet (26) of the line is printed deviating from the regular droplet pattern, thereby adapting the continuously wet-on-wet printed line for compensating for ink flow behavior which causes deviation from the image to be printed.

21 Claims, 3 Drawing Sheets

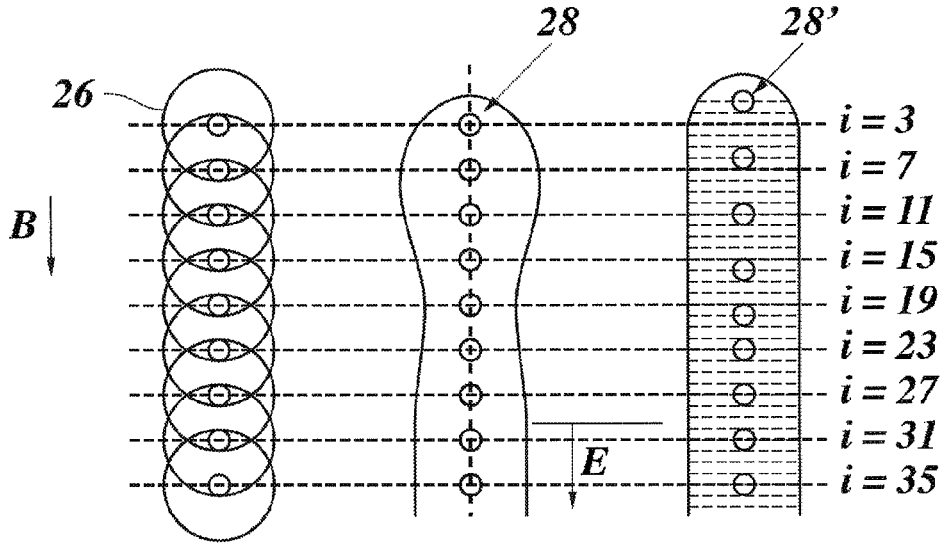
Fig. 2A Fig. 2B Fig. 2C
Fig. 3
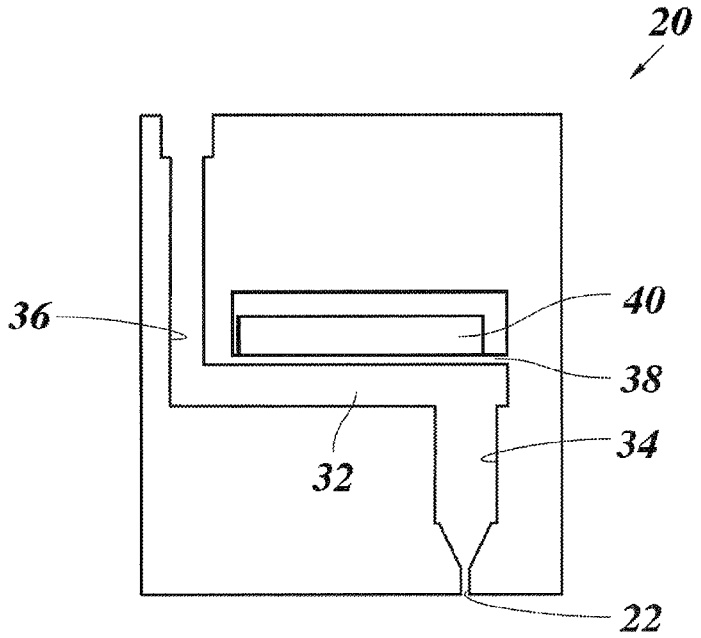

PRINTING METHOD

CROSS REFERENCE TO RELATED APPLICATIONS

This application is a Bypass Continuation of PCT International Application No. PCT/EP2012/054772 filed on Mar. 19, 2012, which claims priority under 35 U.S.0 §119(a) to patent application Ser. No. 11/161,254.5 filed in Europe on Apr. 6, 2011, all of which are hereby expressly incorporated by reference into the present application.

The invention relates to a method of printing by depositing liquid droplets onto a substrate. In particular, the invention relates to such method comprising printing a line in a printing direction.

In the field of ink jet printing, it is known that for certain applications, a particularly high printing quality is required. Among these applications are the printing of etch or plating resist, printing of isolation, semi-conductive or conductive inks, printing of metal from the melt, printing of solder mask and other applications.

It is an object of the invention to provide a method of printing by depositing liquid droplets onto a substrate, which allows to print thin lines with improved printing quality.

According to the invention, this object is achieved by a method of printing by depositing liquid droplets onto a substrate, comprising printing a line, wherein the droplets forming the line are continuously printed wet-on-wet, and wherein, at least in a middle part of said line, the droplets are printed according to a regular droplet pattern, and wherein, at least in one end part of the line, at least an outermost droplet of the line is printed deviating from the regular droplet pattern, thereby adapting the continuously wet-on-wet printed line. The line may be lengthened or shortened, i.e. lengthened or shortened compared to what would be obtained using the regular droplet pattern throughout the line.

Whether a shortening or lengthening of the line is required for compensating a deviation depends on a number of parameters. Examples of possibly relevant parameters include properties of the ink used, such as viscosity, gelling character, for example, property of the substrate, in particular properties of the substrate interacting with the ink thereby influencing the flow behavior of the ink on the substrate, such as porosity, for example, and properties of the printing process, such as droplet positioning, for example. As herein disclosed, for any combination of predetermined properties (including but not limited to ink, substrate, printing process) a particular deviation from the regular droplet pattern may be determined for adaptation of the printed line.

The droplets forming the line are continuously printed wet-on-wet. That is, adjoining droplets connect to one another in a wet state. In other words, each droplet of the line is deposited while at least the immediately adjoining one or more previously printed droplets are still in a wet state, and there is overlap between adjoining droplets. The printed droplets may solidify or dry after some time, provided that each droplet is still in a liquid state while its adjoining droplet(s) is/are printed. In a line that is continuously printed wet-on-wet according to a regular droplet pattern, usually a substantially uniform line profile results in a middle part of the line. However, it has been found that, at an end part of the line where printing of the line begins or ends, the printed line may be shorter or longer than required by the image to be printed. Furthermore, a deviation of the line thickness from a mean line thickness may occur in an end part of the line. Such effects are expected to be due to coherent forces in the wet state of the printed liquid droplets.

In the middle part of the line, the droplets are printed according to a regular droplet pattern. For example, the droplets are printed at positions according to the regular droplet pattern. For example, depending on the volume of the droplets and the spread of the droplets on the substrate, a mean line width can be provided by choosing a droplet pattern with a required droplet distance.

By printing at least an outermost droplet of the line deviating from the regular droplet pattern, and thereby adapting, possibly including slightly lengthening or shortening, the continuously wet-on-wet printed line, a deviation of the printed line from a desired line can be prevented by compensating an imperfection of a line printed by only using the regular print pattern. Thus, a deviation of the printed line due to coherent forces within connected wet droplets may be counteracted. Thus, the actually printed image may more closely resemble the image to be printed. This is especially important for printing of accurate patterns including lines.

For example, the droplets forming the line are printed at positions that are in line with one another. Thus, a very thin line is printed. When printing thin lines, accuracy demands are even higher. Moreover, the effects of coherent forces within the liquid droplets may be stronger in thin lines. Thus, compensation of these effects is particularly advantageous. For example, the line is a rectangular line.

The invention further relates to a printer adapted to said method.

In one embodiment, the printing direction may be a main scanning direction of a printhead which is moved over the substrate in the main scanning direction and which comprises an array of nozzles extending in a sub-scanning direction generally perpendicular to the main scanning direction. After printing one or more paths in the main scanning direction, the substrate is moved relative to the printhead in the sub scanning direction. In another embodiment, a line or array of nozzles may extend over the width of the substrate and the substrate is moved relative to the nozzles only in a main scanning direction, the printing direction being defined as the direction of movement of the nozzles relative to the substrate.

Further preferred embodiments of the invention are indicated in the dependent claims.

For example, at least in said one end part of the line, the droplets are printed according to a compensation pattern, the compensation pattern deviating from the regular droplet pattern regarding at least one of droplet positions, droplet volumes and number of droplets per length. For example, by changing a droplet position or placing a droplet further to the end of the line, the line may be adapted. For example, by increasing the volume of the outermost droplet at the end of the line, the line may be lengthened. For example, by increasing the droplet density or number of droplets per length of the line, the available amount of liquid may be increased in the end part of the line, resulting in a lengthening of the line. For example, the compensation pattern comprises droplet positions deviating from the droplet positions of the regular droplet pattern. In particular, for example, the droplet positions deviate in the line direction, i.e. in the printing direction. For example, the compensation pattern comprises droplet volumes deviating from droplet volumes of the regular droplet pattern.

In particular, a compensation pattern as described above may be used in printing both end parts of a line. Thus, the method allows to compensate for line deformation effects due to flow behavior of the printed wet droplets when starting and ending a continuously wet-on-wet printing of a line. Printing an outermost droplet of a line deviating from the regular droplet pattern and thereby slightly lengthening the continuously wet-on-wet printed line is one example of printing the droplets in an end part of the line according to a compensation pattern. A compensation pattern may comprise deviations from the regular droplet pattern regarding more than an outermost droplet. For example, an end part of a line and a corresponding compensation pattern may comprise the first or last tens of droplets of a line.

In one embodiment, the method further comprises first printing at least one test line and detecting a profile of the printed test line, wherein the compensation pattern is determined based on the detected profile. For example, the compensation pattern may be calculated based on the detected profile as will be described further below. Printing a test line and detecting a profile of the printed test line allows to adapt the compensation pattern to actual conditions of the substrate and the printing liquid, e.g. ink. Moreover, the method may further comprise a step of printing at least one further test line using the compensation pattern for printing at least an outermost droplet of the test line in at least one end part of the test line, and a step of detecting a profile of the printed at least one further test line as well as a step of determining a new compensation pattern based on the newly detected profile. These steps may be iteratively performed. Thus, the compensation pattern may be iteratively refined. For example, a camera or CCD array may be used for detecting said profile.

According to a further aspect of the invention, there is provided a method of printing by depositing liquid droplets onto a substrate, comprising printing a line in a printing direction, the method comprising printing a first line segment of the line and printing a second line segment of the line,

- wherein the first line segment is printed using a first nozzle for jetting said liquid droplets onto the substrate,
- wherein the second line segment is printed using a second nozzle for jetting said liquid droplets onto the substrate,
- wherein the droplets forming the first line segment are continuously printed wet-on-wet,
- wherein, at least in a middle part of said first line segment, the droplets are printed according to a regular droplet pattern,
- wherein, at least in one end part of the first line segment, at least an outermost droplet of the first line segment is printed deviating from the regular droplet pattern, thereby lengthening the continuously wet-on-wet printed first line segment,
- wherein the droplets forming the second line segment are continuously printed wet-on-wet,
- wherein an end part of the second line segment at least partially overlaps with said outermost droplet of one of said at least one end part of the first line segment.

Each line segment in itself is a line. Thus, instead of using the terms "a first line segment of the line" and "a second line segment of the line", the method can also be described as printing "a first line" and printing "a second line", the first and second lines together forming a longer (rectilinear) line. In the following, both terminologies will be used and are interchangeable.

Preferably, at least in a middle part of the second line, the droplets are printed according to the regular droplet pattern, and, at least in said end part of the second line, at least an outermost droplet of the second line is printed deviating from the regular droplet pattern, thereby lengthening the continuously wet-on-wet printed second line. Thus, a disturbance of the line profile at a transition between the first line (or first line segment) and second line (or second line segment) may be minimized or avoided. For example, when the first line is printed first, and the droplets of the first line have already solidified when the second line is begun, the first line is not in a wet state when the first droplets of the second line are printed. Thus, a discontinuity of the resulting longer line may be avoided or minimized. This is particularly advantageous in case that the second nozzle is used for replacing the first nozzle, when a malfunction of the first nozzle has been predicted.

According to a further aspect of the invention, there is provided a method of printing by depositing liquid droplets onto a substrate, comprising printing a line in a printing direction, wherein a first line segment of the line is printed using a first nozzle for jetting said liquid droplets onto the substrate, the method further comprising:

- measuring a signal indicative of a condition of droplet formation of the first nozzle, and
- based on said signal, deciding whether to abort printing the line segment that is currently printed using said first nozzle and to print a second line segment of the line using a second nozzle for jetting said liquid droplets onto the substrate,
- wherein the droplets forming the first line segment are continuously printed wet-on-wet, and
- wherein, at least in a middle part of said first line segment, the droplets are printed according to a regular droplet pattern, and
- wherein, at least in one end part of the first line segment, at least an outermost droplet of the first line segment is printed deviating from the regular droplet pattern, thereby lengthening the continuously wet-on-wet printed first line segment,
- wherein the droplets forming the second line segment are continuously printed wet-on-wet, and
- wherein an end part of the second line segment at least partially overlaps with said outermost droplet of one of said at least one end part of the first line segment.

In other words, when a first line is printed, and it is decided to abort printing that line, an end part of the line will be printed as described, and a second line will be printed, an end part of the second line at least partially overlapping with the outermost droplet of said end part of the first, aborted line. Thus, the second line replaces the remainder of the aborted line.

Thus, if, according to the signal, a malfunction of the first nozzle is to be expected, the first nozzle may be replaced by the second nozzle for printing the remainder of the line. Because at least the first line segment is slightly lengthened, a disturbance of the line profile at the transition from the first line segment to the second line segment can be minimized or avoided.

Preferably, at both end parts of the first line segment, at least a respective outermost droplet of the line segment is printed deviating from the regular droplet pattern, thereby lengthening the continuously wet-on-wet printed line segment.

Preferably, at least in a middle part of the second line segments, the droplets are printed according to a regular droplet pattern, and, at least in one end part of the second line segment, at least an outermost droplet of the second line segment is printed deviating from the regular droplet pattern, thereby lengthening the continuously wet-on-wet printed second line segment. More preferably, in both end parts of the second line segment, at least a respective outermost droplet of the second line segment is printed deviating from the regular droplet pattern, thereby lengthening the continuously wet-on-wet printed second line segment.

Preferred embodiments of the invention will now be explained in conjunction with the drawings, wherein:

FIG. 2A-2C show diagrams of droplet positions and resulting line profiles;

FIG. 3 is a schematic cross-sectional partial view of an ink jet printhead.

Figure 1:
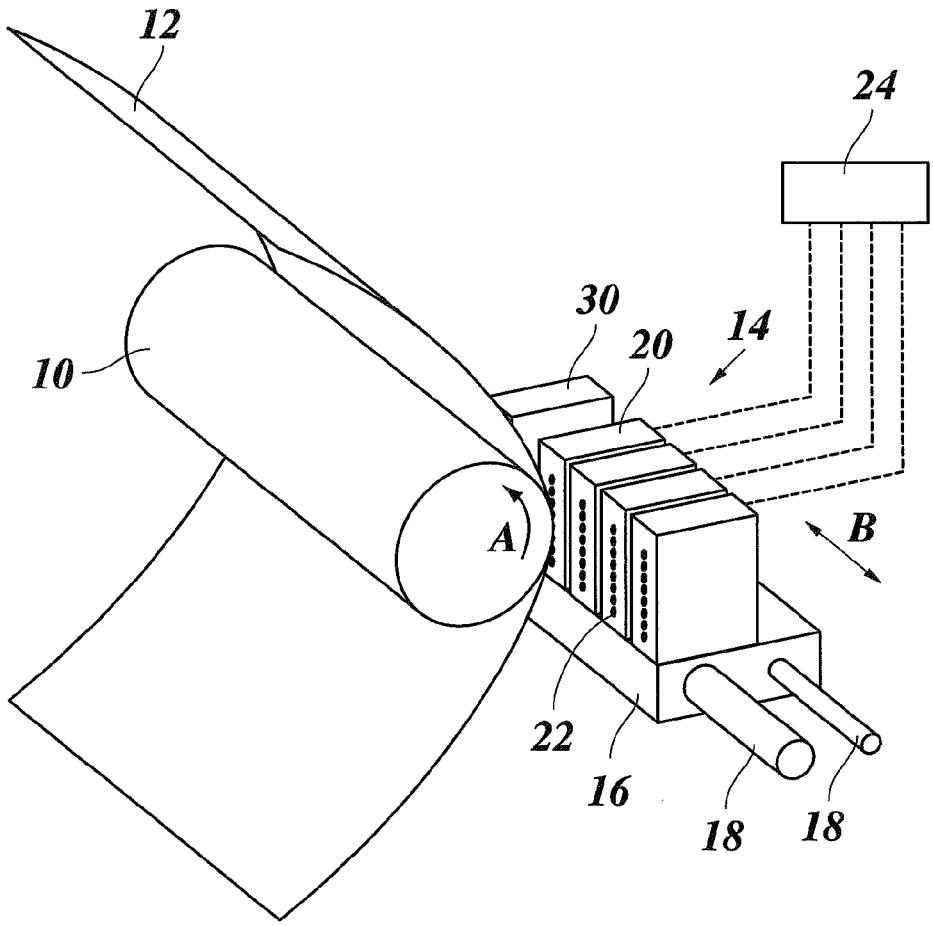
FIG. 1 is a schematic view of an ink jet printer to which the invention is applicable.

FIG. 1 schematically shows an ink jet printer comprising a roller 10 which serves for transporting a recording substrate 12, e.g. paper, in a sub-scanning direction (arrow A) past a printhead unit 14. The printhead unit 14 is mounted on a carriage 16 that is guided on guide rails 18 and is moveable back and forth in a main scanning direction (arrow B) relative to the recording substrate 12. The main scanning direction is the printing direction, e.g. the direction of relative movement between the printhead unit 14 and the substrate 12 during the actual printing.

In the example shown, four printheads 20 of the printhead unit 14 are illustrated. In practice, the printhead unit 14 may comprise any number of printheads 20. In one embodiment, the printhead unit 14 comprises eight printheads 20, two for each of the basic colours cyan, magenta, yellow and black.

Each printhead 20 has a linear array of nozzles 22 extending transverse to the printing direction. The nozzles 22 of the printheads 20 can be energized individually to eject ink droplets onto the recording substrate 12, thereby to print a pixel on the substrate. When the carriage 16 is moved in the direction B across the width of the substrate 12, a swath of an image can be printed. The number of pixel lines of the swath corresponds to the number of nozzles 22 of each printhead. When the carriage 16 has completed one path, the substrate 12 is advanced by the width of the swath, so that the next swath can be printed.

The printheads 20 are controlled by a control system comprising a processing unit 24 which processes the print data in a manner that will be described in detail hereinbelow. The discussion will be focused on printing in one colour, but is equivalently valid for printing in more than one colour.

In the example, two printheads 20 are provided for each basic colour. For each colour, thus, a first printhead 20 and a second printhead 20 are provided and are arranged next to each other on the printhead unit 14. Corresponding nozzles 22 of the first and second printheads 20 are aligned in the printing direction B. Thus, there is redundancy, and a failing first nozzle 22 of a first printhead 20 may be substituted by a second nozzle 22 of a second printhead 20 of the same colour and the same position transverse to the printing direction B.

A first example of a method of printing will be explained hereinbelow with reference to FIG. 2A-2C. It is noted that hereinafter a detailed description of an embodiment wherein a shortening of the printed line would result, if no adaptation in accordance with the present invention would be applied, is provided. However, the described method may be equally applied for suitably adapting a line that would be lengthened if no adaption would be applied, as readily recognized by a person skilled in the art.

FIG. 2A schematically shows positions and approximate sizes of a series of droplets 26 printed at equidistant positions in the printing direction B. All droplets 26 are printed by a first nozzle 22. As the droplets 26 are deposited in a liquid state on the substrate 12, the ink may spread on the substrate 12, while it is still in a wet state. When adjoining droplets 26 are printed in time intervals during which the ink remains wet, and when adjoining droplets 26 overlap, the adjoining droplets 26 connect to one another in their wet state. Thus, a line is continuously printed wet-on-wet.

FIG. 2B illustrates a line profile at an end part of a line. In the example shown, only one of the two end parts of the line is shown, and a middle part of the line is partially shown. In the example described, printing of the line begins at the illustrated end part of the line. In the end part as well as in the middle part of the line, the droplets are printed according to a regular droplet pattern as indicated in FIG. 2A. That is, the droplets are printed at equidistant positions and have a uniform droplet volume. The droplet positions are indicated by small circles. The droplets are aligned in the printing direction B.

Printing of the line begins at a droplet position 28, at which an outermost droplet 26 of the end part of the line is printed. In FIG. 2B, this droplet position 28 is the topmost droplet position. As is schematically indicated in FIG. 2A-2C, the line profile deviates from an ideal profile, which is due to coherent forces in the wet state of the droplet 26. Due to the coherent forces, an ink flow behavior takes place at the end parts of a line that is continuously printed wet-on-wet. In particular, it is noticed that the resulting line is slightly shortened, since ink of the outermost droplet at droplet position 28 is drawn towards the adjoining droplet 26. Therefore, the outermost droplet spreads further towards the adjoining droplets of the line than in the opposite direction.

While FIG. 2A-2C describes the ink flow behavior in an end part of the line, in which the line starts, a similar ink flow effect will occur in the other end part of the line, where the last droplets of the line are printed. The degree in which this "start" and "stop" flow behavior will occur depends on the rheological behavior of the ink, such as the viscosity and solidification time or, depending on the type of ink, gelling and fixation time. The effects are particularly large at inks having a low viscosity, low gelling and a slow fixation time. FIG. 2B illustrates a typical line profile showing a thickening near the line end and a narrowing closer to the middle part of the line.

In order to counteract these effects, in the described method, the droplets 26 of the end part of the line are printed according to a compensation pattern, which deviates from the regular droplet pattern. In FIG. 2C, droplet positions according to a compensation pattern are shown, and a resulting line profile of the end part of the line is illustrated. In the example shown, the compensation pattern deviates from the regular droplet pattern regarding the droplet positions. The droplet volumes correspond to the uniform droplet volume of the regular droplet pattern, and the number of droplets per length of line also corresponds to the uniform number of droplets per length of the regular droplet pattern. However, since the droplet positions are different from the droplet positions of the regular droplet pattern, the compensation pattern deviates from the regular droplet pattern regarding a printing density distribution in the line direction (i.e. a number of droplets per unit length of the line). For example, at the outermost half of the end part of the line, a mean droplet distance is larger than the uniform droplet distance in the middle part of the line. And in the other portion of the end part, the mean droplet distance is smaller than the regular droplet distance of the regular droplet pattern.

In the example shown, the outermost droplet of the line is printed at a droplet position 28' that is further towards the end of the line than the droplet position 28. Thereby, the line is slightly lengthened. Thus, the effect of line shortening illustrated in FIG. 2B is compensated. Furthermore, due to a larger mean distance of the first four printed droplets, the thickening effect is counteracted, and due to a lower mean distance of the next droplets, the narrowing effect is counteracted. As a result, a more uniform line profile is achieved.

Whereas a suitable compensation pattern may be determined by trial and error, knowing the general ink flow behavior and taking into account the printing speed, an example of determining a compensation pattern from a printed test line will be described below.

In the example, during a calibration procedure, test lines are printed, and profiles of the printed test lines are detected using a vision system 30, such as a CCD camera, schematically illustrated in FIG. 1. The camera is a high resolution camera able to detect a line profile with the required accuracy. The compensation pattern is determined based on the detected profiles as described in the following.

With the following steps the compensation scheme is defined.

Step 1: Print Test Lines

In step 1, a test pattern with several lines of droplet series is printed using a respective regular droplet pattern. Within each line or droplet pattern, the droplet distance d is fixed. Various test lines can have various droplet distance d. Typically, the maximum distance d is half of the droplet diameter on the substrate. Thus, the droplets are printed continuously wet-on-wet.

The left part of FIG. 2 corresponds to one test line having a fixed droplet distance d. The regular droplet pattern illustrated in the left part of FIG. 2 corresponds to a distance d that is slightly smaller than the maximum droplet distance of half the droplet diameter.

For example, five test lines may be printed according to the following parameters:

Droplet volume $V_{drop}$=30 pl;

Pixel size, i.e. resolution of droplet positions, p=5 μm;

Line 1: d=35 μm (bitmap 100000010000001 etc.);

Line 2: d=30 μm;

Line 3: d=25 μm;

Line 4: d=20 μm; and

Line 5: d=15 μm (bitmap 1001001001001 etc.).

Step 2: Determining Line Width of Test Lines

In step 2, for each test line, the line width is measured at a position distant from the ends of the line, where the line width has reached its equilibrium. The line width is measured in a middle part of the line where no end effects due to ink flow behavior occur. The beginning of the middle part of the line is indicated by an arrow E in the example of the middle part of FIG. 2, i.e. begins approximately at the ninth droplet.

A fitting algorithm of this line width at equilibrium $w_{eq.}$ as a function of the droplet distance d is performed. For example, the fitting is based on the formula $w_{eq.}$=const.*$(1/d)^{1/2}$.

For example, the line widths may be:

Line 1: $w_{eq.}$=68 μm;

Line 2: $w_{eq.}$=74 μm;

Line 3: $w_{eq.}$=81 μm;

Line 4: $w_{eq.}$=91 μm;

Line 5: $w_{eq.}$=105 μm, and the fitting algorithm may yield: const.=405.

Step 3: Detecting a Line Profile

In this step, a line profile of an end part of a test line is detected, in which end part end effects due to ink flow behavior may occur. The line profile is measured as a series of local line widths $w_i$ for a selected range in which a compensation for ink flow behavior is required, at positions i=1 upto i=n.

This is repeated for each printed test line. For one exemplary line of the test lines, the following line profile may be measured:

$w_1$=40 μm, $w_9$=107 μm, $w_{17}$=78 μm, $w_{25}$=87 μm, $w_{33}$=91 μm, $w_2$=68 μm, $w_{10}$=106 μm, $w_{18}$=75 μm, $w_{25}$=89 μm, $w_{33}$=91 μm, $w_3$=83 μm, $w_{11}$=104 μm, $w_{19}$=74 μm, $w_{27}$=90 μm, $w_{35}$=91 μm, $w_4$=91 μm, $w_{12}$=102 μm, $w_{20}$=75 μm, $w_{28}$=91 μm, $w_{36}$=91 μm, $w_5$=97 μm, $w_{13}$=98 μm, $w_{21}$=77 μm, $w_{29}$=91 μm, $w_{37}$=91 μm, $w_6$=102 μm, $w_{14}$=94 μm, $w_{22}$=79 μm, $w_{30}$=91 μm, $w_{38}$=91 μm, $w_7$=104 μm, $w_{15}$=90 μm, $w_{23}$=82 μm, $w_{31}$=91 μm, $w_{39}$=91 μm, $w_8$=106 μm, $w_{16}$=84 μm, $w_{24}$=85 μm, $w_{32}$=91 μm, $w_{40}$=91 μm.

Step 4: Calculate Cumulated Ink Volume for a Series of Positions

In this step, beginning with the end of the respective line, the cumulated ink volume as a function of position i is calculated.

At equilibrium, it is assumed that the cumulated line volume increases with the droplet volume each time the position i is incremented by d/p:

$$V_i = i*30\text{pl}*p/d.$$

Before equilibrium has been reached, i.e. in the end part of the line, this linearity does not account due to ink flow behavior. There the measured line widths of step 3 can be used to define the cumulated ink volume in the line as:

$$V_i = \Sigma_{i=1:n} 30\text{pl}*p*(w_i/\text{const.})^2.$$

For the measured line widths in the example of step 3, this would result in:

$V_1$=1.4 pl, $V_9$=68.2 pl, $V_{17}$=134.2 pl, $V_{25}$=180.3 pl, $V_{33}$=240.0 pl, $V_2$=5.7 pl, $V_{10}$=78.5 pl, $V_{18}$=139.3 pl, $V_{26}$=187.5 pl, $V_{34}$=247.5 pl, $V_3$=12.0 pl, $V_{11}$=88.4 pl, $V_{19}$=144.3 pl, $V_{27}$=194.9 pl, $V_{35}$=255.0 pl, $V_4$=19.5 pl, $V_{12}$=97.9 pl, $V_{20}$=149.5 pl, $V_{28}$=202.5 pl, $V_{36}$=262.5 pl, $V_5$=28.2 pl, $V_{13}$=106.7 pl, $V_{21}$=154.9 pl, $V_{29}$=210.0 pl, $V_{37}$=270.0 pl, $V_6$=37.7 pl, $V_{14}$=114.7 pl, $V_{22}$=160.6 pl, $V_{30}$=217.5 pl, $V_{38}$=277.5 pl, $V_7$=47.6 pl, $V_{15}$=122.2 pl, $V_{23}$=166.7 pl, $V_{31}$=225.0 pl, $V_{39}$=285.0 pl, $V_8$=57.8 pl, $V_{16}$=128.6 pl, $V_{24}$=173.4 pl, $V_{32}$=232.5 pl, $V_{40}$=292.5 pl.

Step 5: Determine Calculated Droplet Positions

In this step, droplet positions are calculated based on the measured line profile. Apparent droplet positions are calculated which would approximately result in the actually measured line profile if no ink flow effect took place.

Thus, the ink volume replacement due to ink flow behavior is determined by comparing the actual positions of printed droplets with the apparent droplet volumes calculated based on steps 1 to 4.

For example, the calculated position for the first droplet corresponds with i=5, because $V_5$ is the closest to half the droplet volume (15 pl); the calculated position for the second droplet corresponds with i=8, because $V_g$ is the closest to 1.5 times the droplet volumes (45 pl); the calculated position for the third droplet corresponds with i=11, because $V_{11}$ is the closest to 2.5 times the droplet volumes (75 pl); etc.

The actual droplet positions $i_{actual}$ and the calculated droplet positions $i_{calc}$ are:

Drop 1: $i_{actual}$=3, $i_{calc}$=5

Drop 2: $i_{actual}$=7, $i_{calc}$=8

Drop 3: $i_{actual}$=11, $i_{calc}$=11
Drop 4: $i_{actual}$=15, $i_{calc}$=14
Drop 5: $i_{actual}$=19, $i_{calc}$=18
Drop 6: $i_{actual}$=23, $i_{calc}$=23
Drop 7: $i_{actual}$=27, $i_{calc}$=27
Drop 8: $i_{actual}$=31, $i_{calc}$=31
Drop $i_{actual}$=35, $i_{calc}$=35
Drop 10: $i_{actual}$=39, $i_{calc}$=39

Step 6: Calculate Compensation Pattern Based on the Calculated Droplet Positions In this step, the compensated droplet positions to reach the required line profile are calculated according to the formula $i_{comp}=i_{actual}-(i_{calc}-i_{actual})$.

Thus:

Drop 1: $i_{comp}$=1
Drop 2: $i_{comp}$=6
Drop 3: $i_{comp}$=11
Drop 4: $i_{comp}$=16
Drop 5: $i_{comp}$=20
Drop 6: $i_{comp}$=23
Drop 7: $i_{comp}$=27
Drop 8: $i_{comp}$=31
Drop 9: $i_{comp}$=35
Drop 10: $i_{comp}$=35

The compensation pattern results in the replacement of the original bitmap

0010001000100010001000100010001000100010 by

1000010000100100010000100010001000100010

Rounding errors and the fact that the method of the example is a first order compensation might lead to imperfect compensation schemes. The compensation pattern can be improved by using smaller steps of i, or by making a second test print with lines based on the first calculated compensated schemes. When steps 1 to 6 are repeated, the resulting second compensation patterns can be an improvement of the first ones. This iterative approach can be repeated for multiple times.

The above procedure may be performed by a printer having a vision system as described above. However, the compensation pattern may also be determined beforehand or offline, e.g., during a factory calibration procedure, or may be determined exemplarily, and the determined compensation pattern may be implemented in the processing unit 24 of the printer.

The described printing method may be advantageously applied to a printer, in which a malfunction of a printing nozzle 22 may be predicted, and in which a substitute nozzle can take over the roll of a nozzle that is predicted to malfunction. An example will be described below with reference to FIG. 3 and FIG. 4.

In FIG. 3, a part of a printhead 20 is shown having a pressure generation chamber 32 which is connected via a feed through 34 to a printhead nozzle 22. Ink is supplied to the pressure generation chamber 32 through an inlet 36, which is e.g. connected to a common ink supply channel of several pressure generation chambers 32. The pressure generation chamber 32 is, in a use state, filled with ink. A substantial part of a wall of the pressure generation chamber 32 is formed by a flexible wall or member 38 of a piezoelectric actuator 40.

In order to eject a droplet from the nozzle 22, the actuator 40 is electrically energized so that it is deformed. A pressure wave is formed in the chamber 32 as a result of this deformation, by means of which pressure wave a droplet of ink is ejected from the nozzle 22, and the actuator 40 is deformed, as a result of which deformation said actuator generates an electric signal, and said electric signal is analyzed. The signal is indicative of a condition of droplet formation of the nozzle 22 and may allow to predict a misfiring or other malfunction of the nozzle 22.

A method of analyzing said signal is known from the European patent application EP 1 013 453 A2 or the European patent application EP 1 584 473 A1. From these applications, it is known that analysis of the signal enables information to be obtained concerning the state of the pressure generation chamber 32 corresponding to said actuator. Thus, it is possible to derive from this signal whether there is an air bubble or other irregularity in the chamber, whether the nozzle is clean, whether there are any mechanical defects in the chamber, and so on. In this way, the irregularity which may have a negative effect on the print quality can be traced on the fly very accurately, so that adequate action can be taken to obviate such a negative effect.

Depending on the measured signal, the processing unit 24 may decide to substitute a first nozzle 22 of a first printhead 20 by a second nozzle 22 of the second printhead 20. Thus, the printing process of a failing nozzle may be taken over with a well functioning nozzle even before the failing nozzle causes unacceptable irregularities in the printed image. In particular, for example, a second nozzle may take over the roll of a first nozzle while a line is printed by said first nozzle. An example will be described with regard to FIG. 4.

Figure 4:
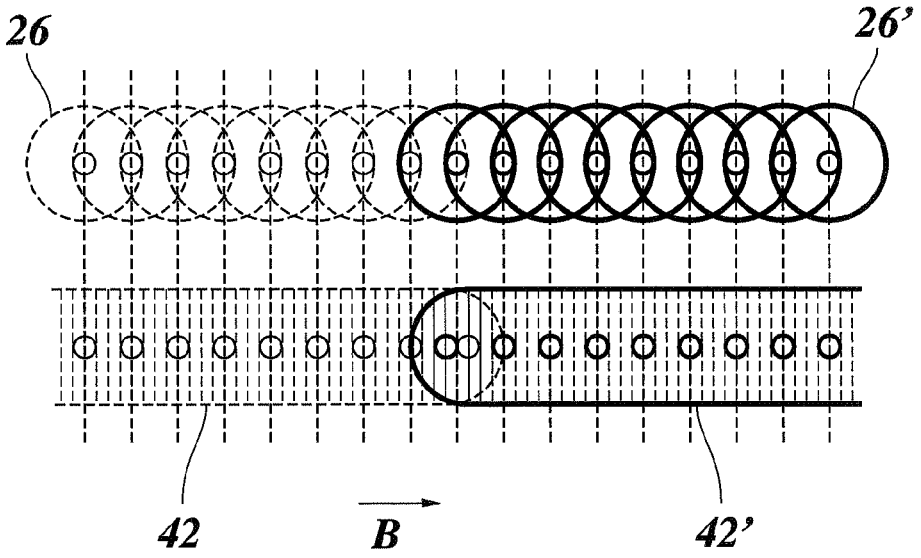
FIG. 4 is a diagram illustrating printing a line having two line segments.

FIG. 4 illustrates an example of printing a line in the printing direction B. The line is printed using a first nozzle 22 for jetting first droplets 26 onto the substrate 12. In the upper part of FIG. 4, a regular droplet pattern is illustrated. The positions of the droplets are indicated by small circles, and the approximate size of the droplets spread on the substrate 12 is indicated by larger circles. As described above, the droplets 26 are continuously printed wet-on-wet, and adjoining first droplets 26 of the line connected to one another in a wet state.

During printing of the line, the signal is measured indicative of a condition of droplet formation of the first nozzle 22, as has been described above. For example, the signal is measured after each injection of a droplet 26. Based on the signal, the processing unit 24 decides whether to continue printing using the first nozzle 22, or whether to interrupt printing with the first nozzle 22. For example, the signal may indicate that a malfunction of the first nozzle 22 is to be expected. For example, the processing unit 24 may process the signal, and based on the signal may predict that a malfunction of the first nozzle 22 is to be expected. For example, the processing unit 24 may predict that in several hundreds of actuations the first nozzle 22 will probably fail. In this case, the first nozzle 22 should not continue printing the line in the same way, because then it will soon fail, causing an unacceptable deviation of the printed line profile from the print image.

Based on the signal, the processing unit 24 decides whether to interrupt printing a first line segment 42 currently being printed using the first nozzle 22 and to print a second line segment 42' of the line using a second nozzle 22. In the bottom part of FIG. 4, profiles of the first and second line segments 42, 42' are schematically illustrated. Droplets 26 and the line segment 42 are drawn in broken lines. When the second nozzle 22 of a second, redundant printhead 20 of the same colour is to take over printing the line, an end part of the first line segment 42 is printed according to a compensation pattern, the compensation pattern deviating from the regular droplet pattern regarding the position of at least the outermost droplet of the line segment 42.

In the example shown, the first nozzle 22 decelerates or delays the last, outermost droplet 26 of the first line segment 42. In the bottom part of FIG. 4, the droplet positions are indicated by small circles. As is illustrated, the position of the last droplet of the first line segment 42 is shifted further towards the end of the line segment. Injection of a droplet may be decelerated, for example, by actuating the piezoelectric actuator 40 of that nozzle 22 with a different pulse shape, for example having a lower amplitude. It is further possible to delay a droplet by delaying the actuation of the piezoelectric actuator 40. Such measures will have the effect that the droplet will land later on the substrate 12. Thereby, the continuously wet-on-wet printed first line segment 42 is slightly lengthened. Thus, the effect of line shortening due to the ink flow behavior is counteracted.

When the redundant second nozzle 22 of the second printhead 20 takes over printing the line by printing the second line segment 42' using second droplets 26', the droplets 26' are printed according to a compensation pattern in the end part at the beginning of the line segment 42'. The compensation pattern deviates from the regular droplet pattern in that the first, outermost droplet of the second line segment 42' is printed at a position deviating from the regular droplet pattern, thereby slightly lengthening the second line segment 42'. As is schematically shown in the bottom part of FIG. 4, the second nozzle 22 accelerates printing its first, outermost second droplet 26', so that the droplet lands earlier on the substrate 12. Thus, at the beginning of the second line segment 42', the outermost droplet 26' is printed with more overlap with the last droplet 26 of the first nozzle 22.

If the first droplets 26 have already solidified when printing of the second droplets 26' begins, for example due to a distance between the first nozzle 22 and the redundant second nozzle 22, then the liquid outermost droplet of the second line segment 42' will land on the substrate 12 in overlap with the already solidified last droplet of the first line segment 42. A disturbance of the line profile at the transition between the first and second nozzles 22 may be reduced by printing the overlapping end parts of the first and second line segments 42, 42' using the compensation patterns as described. Whereas placing the outermost droplet further out is a simple compensation scheme, it already has a significant effect on the resulting line profile of the line at the transition between the first and second line segments.

In the example shown, the second line segment 42' replaces the reminder of the line when printing the line using the first nozzle 22 is printed after printing a first line segment 42. Both at the ending of the first line segment 42 and the beginning of the second line segment 42', the respective end part of the respective line segment is printed according to a compensation pattern deviating from the regular droplet pattern.

In the examples of FIG. 2 and FIG. 4, the ink volume used for printing a line or line segment according to a compensation pattern equals the ink volume for the regular droplet pattern. However, with other compensation patterns, the ink volume may deviate from the ink volume according to the regular droplet pattern. For example, with regard to counteracting the line end effect shown in the middle part of FIG. 2, a compensation pattern may comprise printing larger droplets at positions with a too narrow line width and smaller droplets at positions with a too large line width. Thus, when the outermost droplet of an end part of a line is printed with a larger droplet volume, the line is lengthened. For example, droplet volumes of 50 pl, 40 pl, 30 pl, 20 pl or 10 pl may be chosen. When the compensation pattern deviates from the regular droplet pattern regarding droplet volumes, in one example, the droplet positions and number of droplets per length of line could be the same as for the regular droplet pattern. In another example, the compensation pattern may deviate from the regular droplet pattern regarding both droplet positions and droplet volumes.

A compensation pattern that maintains the ink volume of the regular droplet pattern could be particularly useful for printing liquid droplets where the contact angle is a dominant factor in the flow behavior of the wet droplets.

A compensation pattern where the droplet volume and/or the amount of droplets deviates from the regular droplet pattern could be particularly useful for solidifying inks or inks with gelling behavior, for which the rheological state limits the timeframe of the ink flow behavior and contributes to a predictable and reproducible ink flow behavior which causes deviations for only a limited part of the printed line.

The invention may be applied to printing with phase change inks, which solidify or get into a gel phase after some time. For example, when this time is in the order of a millisecond or more, while the droplets of a line in printing direction are printed at intervals of less than a millisecond, adjoining droplets are printed wet-on-wet.

The invention may also be applied for inks, such as UV inks, which are printed wet-on-wet and which solidify by curing or pinning. Another example is printing polymers or polymer like inks which are printed at a high temperature. The cooling of the printed droplets increases the viscosity, which prevents that the droplets remain in the wet state after some time.

The invention may also be applied for printing metals from the melt by printing liquid i.e. melted metal droplets.

The invention claimed is:

1. A method of printing by depositing liquid droplets onto a substrate, comprising printing a line, wherein the droplets forming the line are continuously printed wet-on-wet, and wherein, at least in a middle part of said line, the droplets are printed according to a regular droplet pattern, and wherein, at least in one end part of the line, the droplets are printed according to a compensation pattern that comprises a predetermined deviation of at least a droplet position of an outermost droplet of the line with respect to the regular droplet pattern.

2. The method according to claim 1, wherein the droplets forming the line are printed at positions that are in line with one another.

3. The method according to claim 2, wherein the droplets forming the line are printed using a single nozzle for jetting said liquid droplets onto the substrate.

4. The method according to claim 2, further comprising permitting the printed droplets to substantially solidify and/or dry.

5. The method according to claim 2, wherein, at least in said one end part of the line, the droplets are printed according to a compensation pattern, the compensation pattern deviating from the regular droplet pattern regarding at least one of droplet positions, droplet volumes, and number of droplets per length.

6. The method according to claim 2, wherein the method further comprises printing a second line, the first line and second line together forming a longer line, wherein the first line is printed using a first nozzle for jetting said liquid droplets onto the substrate, and wherein the second line is printed using a second nozzle for jetting said liquid droplets onto the substrate, and wherein the droplets forming the second line are continuously printed wet-on-wet, and wherein an end part of the second line at least partially overlaps with said outermost droplet of one of said at least one end part of the first line.

7. The method according to claim 1, wherein the droplets forming the line are printed using a single nozzle for jetting said liquid droplets onto the substrate.

8. The method according to claim 7, further comprising permitting the printed droplets to substantially solidify and/or dry.

9. The method according to claim 7, wherein, at least in said one end part of the line, the droplets are printed according to a compensation pattern, the compensation pattern deviating from the regular droplet pattern regarding at least one of droplet positions, droplet volumes, and number of droplets per length.

10. The method according to claim 7, wherein the method further comprises printing a second line, the first line and second line together forming a longer line, wherein the first line is printed using a first nozzle for jetting said liquid droplets onto the substrate, and wherein the second line is printed using a second nozzle for jetting said liquid droplets onto the substrate, and wherein the droplets forming the second line are continuously printed wet-on-wet, and wherein an end part of the second line at least partially overlaps with said outermost droplet of one of said at least one end part of the first line.

11. The method according to claim 1, further comprising permitting the printed droplets to substantially solidify and/or dry.

12. The method according to claim 11, wherein, at least in said one end part of the line, the droplets are printed according to a compensation pattern, the compensation pattern deviating from the regular droplet pattern regarding at least one of droplet positions, droplet volumes, and number of droplets per length.

13. The method according to claim 11, wherein the method further comprises printing a second line, the first line and second line together forming a longer line, wherein the first line is printed using a first nozzle for jetting said liquid droplets onto the substrate, and wherein the second line is printed using a second nozzle for jetting said liquid droplets onto the substrate, and wherein the droplets forming the second line are continuously printed wet-on-wet, and wherein an end part of the second line at least partially overlaps with said outermost droplet of one of said at least one end part of the first line.

14. The method according to claim 1, wherein the compensation pattern further deviates from the regular droplet pattern regarding at least one of droplet positions of more than an outermost droplet of the line, droplet volumes, and number of droplets per length.

15. The method according to claim 14, wherein the compensation pattern deviates from the regular droplet pattern to counteract a lateral expansion of the end of the printed line and a lateral contraction in a further inward portion of the end part of the printed line.

16. The method according to claim 15, further comprising first printing at least one test line and detecting a profile of the at least one printed test line, wherein the compensation pattern is determined based on the detected at least one profile.

17. The method according to claim 14, further comprising first printing at least one test line and detecting a profile of the at least one printed test line, wherein the compensation pattern is determined based on the detected at least one profile.

18. The method according to claim 1, wherein the method further comprises printing a second line, the first line and second line together forming a longer line, wherein the first line is printed using a first nozzle for jetting said liquid droplets onto the substrate, and wherein the second line is printed using a second nozzle for jetting said liquid droplets onto the substrate, and wherein the droplets forming the second line are continuously printed wet-on-wet, and wherein an end part of the second line at least partially overlaps with said outermost droplet of one of said at least one end part of the first line.

19. The method according to claim 1, wherein the line is printed using a first nozzle for jetting said liquid droplets onto the substrate, the method further comprising:

measuring a signal indicative of a condition of droplet formation of the first nozzle, and based on said signal, deciding whether to abort printing the line that is currently printed using said first nozzle and to print a second line using a second nozzle for jetting said liquid droplets onto the substrate, the first line and second line together forming a longer line, wherein the droplets forming the second line are continuously printed wet-on-wet, and wherein an end part of the second line at least partially overlaps with said outermost droplet of one of said at least one end part of the first line.

20. A printer comprising a drive system for moving a substrate relative to at least one print head, the at least one print head providing at least one nozzle for ejecting liquid droplets onto the substrate in accordance with print data, the printer having a control system adapted to perform the method of claim 1.

21. The method according to claim 1, wherein the droplets forming the line are continuously printed wet-on-wet such that each droplet is still in a wet state while an adjoining droplet of the line is printed, and wherein adjoining droplets of the line overlap.

* * * * *